United States Patent [19]

Balz

[11] Patent Number: 4,461,122

[45] Date of Patent: Jul. 24, 1984

[54] FINISHING APPARATUS WITH AUTOMATICALLY-VARIABLE VIBROGYRATORY INTENSITY AND/OR DIRECTION

[75] Inventor: Gunther W. Balz, Kalamazoo, Mich.

[73] Assignee: Roto-Finish Company, Inc., Kalamazoo, Mich.

[21] Appl. No.: 289,295

[22] Filed: Aug. 3, 1981

[51] Int. Cl.[3] ..... B24B 31/00

[52] U.S. Cl. ..... 51/163.2; 74/87

[58] Field of Search ..... 198/770; 51/163.1, 163.2, 51/7; 74/87

[56] References Cited

U.S. PATENT DOCUMENTS

| | | | |
|---|---|---|---|
| 3,197,922 | 8/1965 | Smith | 51/163.1 |
| 3,214,363 | 10/1965 | Amori | 198/770 |
| 3,606,702 | 9/1971 | Balz | 51/163.2 |
| 3,608,388 | 9/1971 | Huber | 51/163.2 |
| 3,811,231 | 5/1974 | Kobayashi | 51/163.2 |
| 3,822,604 | 7/1974 | Grimmer | 74/87 |
| 3,920,222 | 11/1975 | Brander | 74/87 |
| 4,042,181 | 8/1977 | Huber et al. | 51/163.1 |

*Primary Examiner*—Harold D. Whitehead

*Attorney, Agent, or Firm*—Gordon W. Hueschen

[57] ABSTRACT

A finishing machine comprising a generally annular finishing chamber having a bottom and upstanding side walls, centrally located vibratory means comprising a substantially vertical shaft with major and minor eccentric weights at each end thereof, one of the eccentric weights at each end of the shaft being fixed, the other of the eccentric weights at each end of the shaft being moveable with respect to said shaft, means operatively associated with said moveable eccentric weights for effecting movement thereof within permissible limits, and limit means defining the permissible movement of the moveable eccentric weight at each end of the shaft, for respectively (a) increasing or decreasing the intensity of vibrations, or (b) reversing the direction of the force factor and hence the direction of flow of mass within the finishing chamber concurrently with an increase or decrease in the intensity of vibrations, depending upon whether the moveable eccentric weights are (a) two minor eccentric weights or two major eccentric weights, or (b) one major eccentric weight and one minor eccentric weight; a vibrogyratory energizing unit, especially suitable for use in such a finishing machine; and a novel method of finishing in such machine, are all disclosed.

38 Claims, 10 Drawing Figures

FINISHING APPARATUS WITH AUTOMATICALLY-VARIABLE VIBROGYRATORY INTENSITY AND/OR DIRECTION

BACKGROUND OF THE INVENTION

1. Field of the Invention

Vibratory finishing machines or apparatus, vibrogyratory energizing packages or units particularly adapted for use in such machines, and vibrogyratory finishing methods.

2. Prior Art

Numerous vibratory and vibrogyratory finishing machines, devices, or apparatus have been proposed, many of which have a finishing chamber of a generally annular nature, usually with an upstanding central column or other space for containment either of an eccentric vibratory motor or a vibrogyratory energy package or unit in either case comprising an essentially vertical shaft having eccentric weights at each end thereof. Various of such machines, and the packages therefor, have been capable of varying degrees of vibratory or vibrogyratory intensity, and some of them have been adapted to vary the location of a weight or weights at the ends of the essentially vertical shaft either prior to or during operation. Some such devices, and the energy packages therefor, have been adapted to reverse the direction of the force factor, and accordingly also the direction of flow of the mass of finishing media and parts or workpieces within the annular finishing chamber, an aspect which is advantageous for separation, especially in certain types of finishing machines, e.g., machines having an inclined ramp which is located out of the path of travel of the mass of parts and workpieces in one direction, but which can be located in said path of travel for facilitating automatic discharge of finished parts or workpieces and finishing media from the machine, advantageously with automatic separation of finished parts from finishing media, when the flow of the mass of media and parts is in the other direction. Representative patents illustrating the foremost state of the art in this area of the finishing field are U.S. Pat. Nos. 3,435,564, 3,466,815, 3,606,702, 3,161,993, U.S. Pat. No. Re 27,084, and U.S. Pat. No. 3,811,231 and patents cited therein. Such finishing machines embodying variable intensity energizing packages or units, and the packages or units themselves, as have been previously available, have been satisfactory in practice to a certain extent, but have left much to be desired. For example, certain of them have been cumbersome and expensive as well as unduly complex, all of them have had limited applicability for either changing intensity of vibrations or for reversing the force factor and consequently the flow of mass within the finishing chamber, and no relatively simple, inexpensive, and generally applicable energizing package or unit, or vibratory finishing machine comprising the same, has been previously available to the finishing industry, much less a versatile, generally applicable energizing unit which is readily controlled by simple means, which may be mechanical, pneumatic, hydraulic, or electric, and which is readily and simply convertible to provide either diminished or increased intensity of vibrogyrations, or alternatively such diminished or increased intensity of vibrogyrations concurrently with reversal of the force factor, as desired by the operator, whether viewed as the vibrogyratory energizing package or unit per se or in place in a vibratory finishing machine for energization thereof. It is apparent that such an improved vibrogyratory energizing package or unit, and vibratory finishing machines comprising the same, which are not characterized by such inherent shortcomings, deficiencies, and disabilities of existing prior art systems, would be highly desirable and would fulfill a long-felt and important need in the finishing art. Such vibrogyratory energizing packages and finishing machines comprising the same are provided by the present invention. In addition, the present invention provides vibrogyratory energizing packages and finishing machines comprising the same which are capable of providing an increased rate of feed at low amplitudes, as compared with usual and standard machines, which are capable of only normal feed at low amplitudes, whereby the separation phase of a finishing operation may be greatly assisted. Moreover, the present invention provides a method comprising a finishing cycle and a separation cycle wherein one cycle is carried out at one vibrogyratory intensity and rate of feed whereas the other cycle is carried out at a reduced vibrogyratory intensity but without a correspondingly diminished rate of feed, again of great assistance especially during the separation phase of the finishing operation.

OBJECTS OF THE INVENTION

The present invention has as an object to provide an improved vibrogyratory energizing package or unit and finishing machines comprising the same. An additional object is to provide such vibrogyratory energizing units which are readily controlled by simple means, which may be mechanical, pneumatic, hydraulic, or electric, for purposes of increasing or decreasing vibratory intensity, as desired. Another object is to provide such improved vibrogyratory energizing units which may be readily controlled to provide reversal of the force factor for reversing the direction of flow of the mass within the finishing chamber of a vibratory finishing machine. A further object of the invention is to provide vibrogyratory energizing packages and finishing machines comprising the same which are capable of providing increased feed at low amplitudes, as contrasted with prior art machines, a capacity which is of great assistance during the separation phase of a finishing operation. A still further object of the invention is to provide such improved vibrogyratory energizing units which are readily, conveniently, and economically convertible from one alternative structure and function to the other. Yet an additional object of the invention is to provide improved finishing machines embodying such improved vibrogyratory energizing units. Yet another object of the invention is to provide an improved finishing method wherein vibrogyratory intensity may be reduced without correspondingly diminishing the rate of feed. Still additional objects of the invention will be apparent to one skilled in the art, and yet other objects will become apparent hereinafter.

The foregoing and additional objects are achieved by provision of novel vibrogyratory energizing units and vibratory finishing machines embodying the same, as well as method of finishing therein, all according to the present invention.

SUMMARY OF THE INVENTION

The invention, in summary, representatively includes the following, inter alia:

In a finishing machine for finishing the surface of unfinished parts with finishing media, comprising a generally annular finishing chamber for receiving unfinished parts and finishing media and for finishing parts therein, said finishing chamber comprising a bottom and upstanding side walls, vibratory means for vibration of said finishing chamber centrally located with respect to said finishing chamber, said vibratory means comprising a substantially vertical shaft having top and bottom eccentric weights, at least one of which eccentric weights being free for movement with respect to said shaft, means operatively associated with any said moveable weight for effecting movement of any said moveable weight within limits, and limit means limiting the extent of movement of any said moveable eccentric weight, the improvement characterized in that said vibratory means comprises major and minor eccentric weights at each end of said shaft, one of said eccentric weights at each end of said shaft being fixed with respect to said shaft, the other of said eccentric weights at each end of said shaft being moveable with respect to said shaft and moveable into substantial coincidence with said fixed eccentric weight at the same end of said shaft and out of coincidence with said fixed eccentric weight at the same end of said shaft, and limit means defining the degree of permissible movement of said moveable eccentric weight at each end of said shaft with respect to said shaft and with respect to said fixed eccentric weight at the same end of said shaft, for respectively (a) increasing or decreasing the intensity of vibrations imparted by said vibratory means, or (b) reversing the direction of the force factor imparted by said vibratory means and hence the direction of flow of mass within said finishing chamber concurrently with an increase or a decrease in the intensity of vibrations imparted by said vibratory means, depending upon whether the moveable eccentric weights are (a) two minor eccentric weights or two major eccentric weights, or (b) one major eccentric weight and one minor eccentric weight; such finishing machine wherein two similar weights at opposite ends of said shaft are moveable with respect to said shaft for increasing or decreasing the intensity of vibrations; such finishing machine wherein the other two weights are similar weights and are fixed weights; such finishing machine wherein the two similar moveable weights are minor weights; such finishing machine wherein two dissimilar weights at opposite ends of said shaft are moveable with respect to said shaft for altering the intensity of vibrations upwardly or downwardly and for reversing the force factor and direction of flow of the mass of media and parts within the finishing chamber; such finishing machine wherein the other two weights are dissimilar weights and are fixed weights; such finishing machine wherein the dissimilar weights comprise one major weight and one minor weight; such finishing machine wherein two eccentric weights at opposite ends of said shaft are normally between about 45° and 135° out of phase with other; such finishing machine wherein both said weights are fixed with respect to said shaft; such finishing machine wherein said weights are major weights; such finishing machine wherein said weights are one major and one minor weight; such finishing machine wherein said fixed weights and moveable weights at each end of said shaft are in essential coincidence at one position defined by said limit means for imparting maximum intensity of vibrogyrations to said finishing chamber; such finishing machine wherein said limit means comprises first limit means defining a position wherein said moveable weights are essentially in coincidence with said fixed weights and second limit means defining a position wherein said moveable weights are up to approximately 180° opposed to said fixed weights; such finishing machine wherein said fixed eccentric weights are approximately 90° out of phase with each other; such finishing machine wherein said annular finishing chamber has an exit opening for exit of finished parts therefrom; such finishing machine wherein said annular finishing chamber has a substantially flat bottom; such finishing machine wherein said annular finishing chamber has an inclined bottom; such finishing machine wherein said inclined bottom comprises a step; such finishing machine wherein said inclined bottom comprises a step and wherein a foraminous member is provided at a level elevated with respect to said bottom of said finishing chamber at or near said step for separation of finished parts from finishing media; such finishing machine wherein said foraminous member is associated with a parts exit; such finishing machine wherein a foraminous member is mounted at an elevated position with respect to the bottom of said finishing chamber for separation of finished parts from finishing media; such finishing machine wherein said foraminous member is associated with a parts exit and a ramp for elevation of parts and finishing media to said foraminous member; such finishing machine wherein any moveable weight is adapted to move upon impact, and including reversible drive means for said shaft operatively associated with said shaft and thereby with said weight for providing impact to any said moveable weight by reversal of said drive means; such finishing machine wherein said drive means for said shaft comprises a motor with associated pulley and belt means which is mounted on said finishing chamber or on a support therefor; such finishing machine wherein said drive means for said shaft comprises a motor and said shaft is the shaft of said motor. Also, a vibrogyratory energizing unit, especially suitable for use in a finishing machine for finishing the surface of unfinished parts with finishing media, comprising a generally annular finishing chamber for receiving unfinished parts and finishing media and for finishing parts therein, said finishing chamber comprising a bottom and upstanding side walls and vibrogyratory means for vibration of said finishing chamber centrally located with respect to said finishing chamber, said vibrogyratory unit comprising a substantially vertical shaft having major and minor eccentric weights at each end of said shaft, one of said eccentric weights at each end of said shaft being fixed with respect to said shaft, the other of said eccentric weights at each end of said shaft being moveable with respect to said shaft and moveable into substantial coincidence with said fixed eccentric weight at the same end of said shaft and out of coincidence with said fixed eccentric weight at the same end of said shaft, limit means defining the degree of permissible movement of said moveable eccentric weight at each end of said shaft with respect to said shaft and with respect to said fixed eccentric weight at the same end of said shaft, for respectively (a) increasing or decreasing the intensity of vibrations imparted by said vibrogyratory means, or (b) reversing the direction of the force factor imparted by said vibrogyratory means and hence the direction of flow of mass within said finishing chamber concurrently with an increase or a decrease in the intensity of vibrations imparted by said vibrogyratory means, depending upon whether the moveable eccentric weights are (a) two minor eccentric weights or two major eccentric weights, or (b) one major eccentric weight and one minor eccentric weight; such unit having means associated with any said moveable weight for effecting movement of any said moveable weight within limits; such unit wherein two similar weights at opposite ends of said shaft are moveable with respect to said shaft for increasing or decreasing the intensity of vibrations; such unit wherein the other two weights are similar weights and are fixed weights; such unit wherein the two similar moveable weights are minor weights; such unit wherein two dissimilar weights at opposite ends of said shaft are moveable with respect to said shaft for altering the intensity of vibrations upwardly or downwardly and for reversing the force factor and direction of flow of a mass of media and parts within a finishing chamber; such unit wherein the other two weights are dissimilar weights and are fixed weights; such unit wherein the dissimilar weights comprise one major weight and one minor weight; such unit wherein two eccentric weights at opposite ends of said shaft are normally between about 45° and 135° out of phase with each other; such unit wherein both said weights are fixed with respect to said shaft; such unit wherein said weights are major weights; such unit wherein said weights are one major and one minor weight; such unit wherein said fixed weights and moveable weights at each end of said shaft are in essential coincidence at one position defined by said limit means for imparting maximum intensity of vibrogyrations to said finishing chamber; such unit wherein said limit means comprises first limit means defining a position wherein said moveable weights are essentially in coincidence with said fixed weights and second limit means defining a position wherein said moveable weights are up to approximately 180° opposed to said fixed weights; such unit wherein said fixed eccentric weights are approximately 90° out of phase with each other; such unit wherein any moveable weight is adapted to move upon impact, and including reversible drive means for said shaft operatively associated with said shaft and thereby with said weight for providing impact to any said moveable weight by reversal of said drive means; such unit including drive means for said shaft comprising a motor; such unit wherein said shaft is the shaft of said motor; and such unit including drive means for shaft comprising a motor with associated pulley and belt means adapted to be mounted on a finishing chamber or on a support therefor. Also, a method for finishing a part or workpiece with finishing media in the finishing chamber of a finishing machine under the influence of vibrogyratory action in which parts and media feed along the finishing chamber of the machine comprising a finishing cycle and a separation cycle, comprising the improvement of carrying out the finishing cycle at one vibrogyratory intensity and rate of feed of parts and media and carrying out the separation cycle at a reduced vibrogyratory intensity but without correspondingly diminishing the rate of feed as compared with a usual vibrogyratory finishing machine; such method wherein concurrently with such reduction in vibrogyratory intensity the force factor is also reversed thereby causing reversal of the direction of feed; such method wherein the vibrogyratory action is imparted by a shaft carrying dissimilar eccentric weights at each end thereof and wherein the reduced vibrational intensity is effected by shifting a weight at each end of said shaft; such method wherein the vibrogyratory action is imparted by shifting dissimilar weights at the ends of said shaft.

DESCRIPTION OF PREFERRED EMBODIMENTS OF THE INVENTION

The invention, in several preferred embodiments, is illustrated by the accompanying drawings, in which.

SPECIFIC REFERENCE TO THE DRAWINGS

Reference is now made to the accompanying drawings for a better understanding of the invention, wherein all the essential parts are numbered and wherein the same numbers or the same numbers in the 100 or 200 series are used to refer to corresponding parts throughout.

Figure 1:
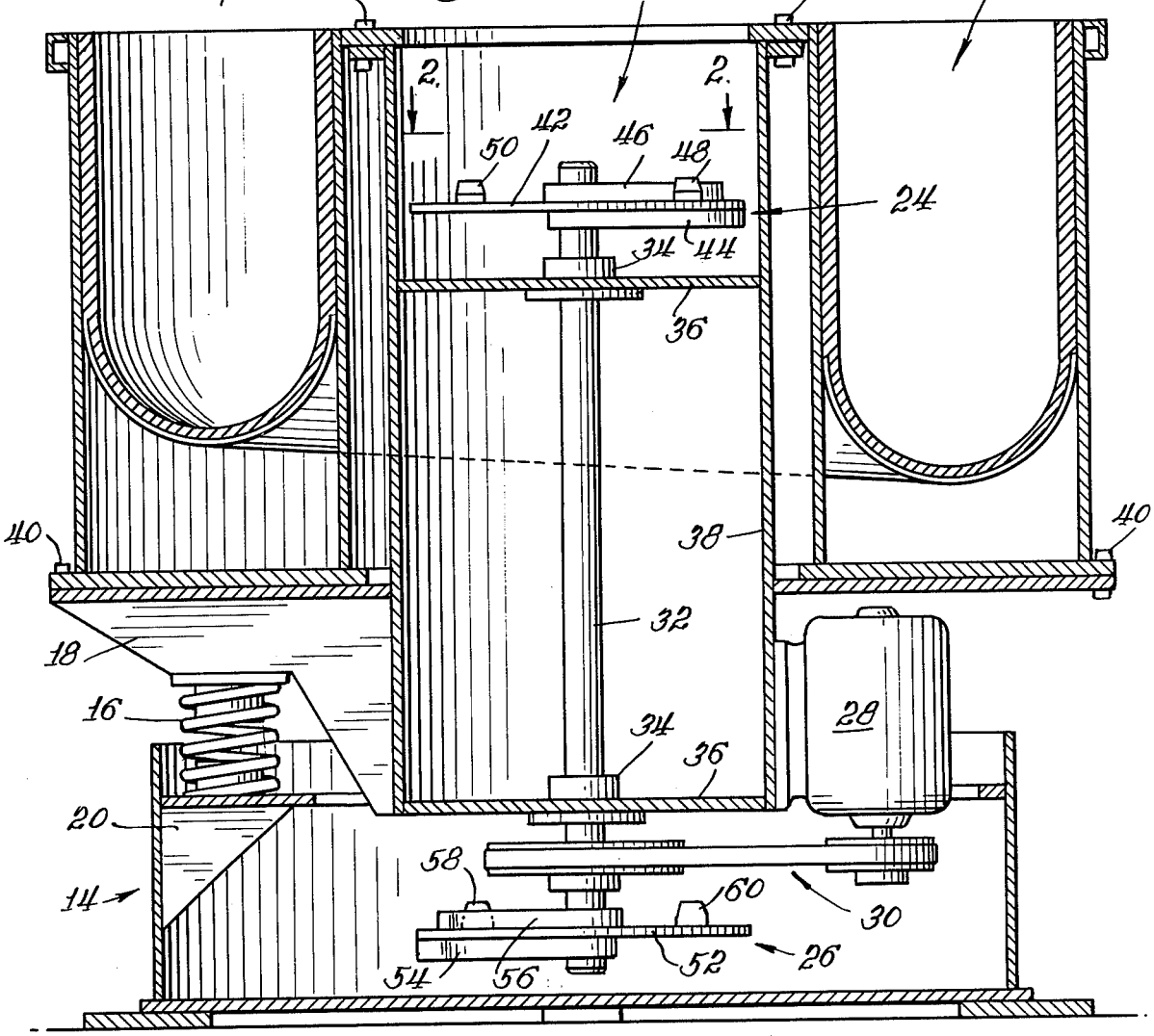
FIG. 1 is a vertical section view of a finishing machine according to the present invention, incorporating a vibrogyratory energizing unit according to the invention.

Referring now to FIG. 1, a finishing machine according to the invention is shown generally at 10. The vibrogyratory energizing unit is shown generally at 22. The machine comprises tub 12, having an inclined bottom which is supported on tubular central column 38 to which it is attached by bolts 40. As shown, tub or finishing chamber 12 has upstanding sidewalls. The finishing chamber 12 is also supported by support means in the form of brackets 18 to which it is also secured by bolts 40. Drive means in the form of motor 28 is supported on central column 38 and the vibratory portion of the finishing machine is resiliently supported on base 14 by means of springs 16 and spring support means 20.

Mounted centrally, in central column 38 by means of plates 36 and bearings 34, is vertical shaft 32 driven by motor 28 by means of belt and pulley arrangement 30. Mounted at the top and bottom of vertical shaft 32 are top and bottom discs 42 and 52, respectively bearing fixed major weights 44 and 54 and free or moveable minor weights 46 and 56 which may be rotatably attached to vertical shaft 32 by means of a collar or sleeve bearing 47. Also shown on upper and lower discs 42 and 52 are limit means 48 and 58, respectively, for defining a position wherein the moveable minor weights are essentially in coincidence with the fixed major weights, and second limit means 50 and 60, respectively, defining a position wherein said moveable minor weights are out of coincidence with said fixed major weights. As shown, said second limit means define a position wherein said moveable weights 46, 56 are approximately 180° opposed to fixed weights 44, 54.

Figure 2:
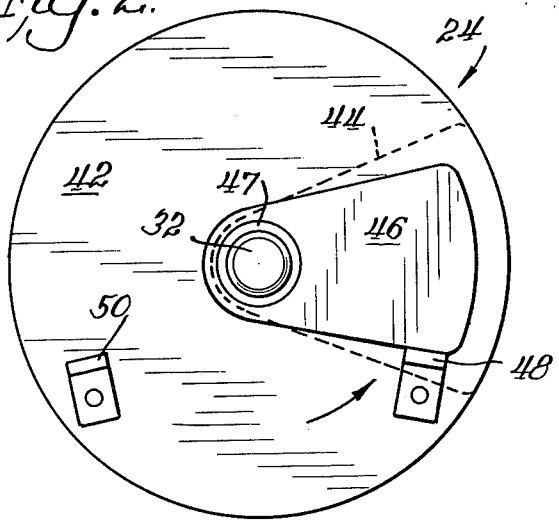
FIG. 2 is a top plan view of the upper portion of the vibrogyratory energizing unit of the invention taken along line 2—2 of FIG. 1.
Figure 3:
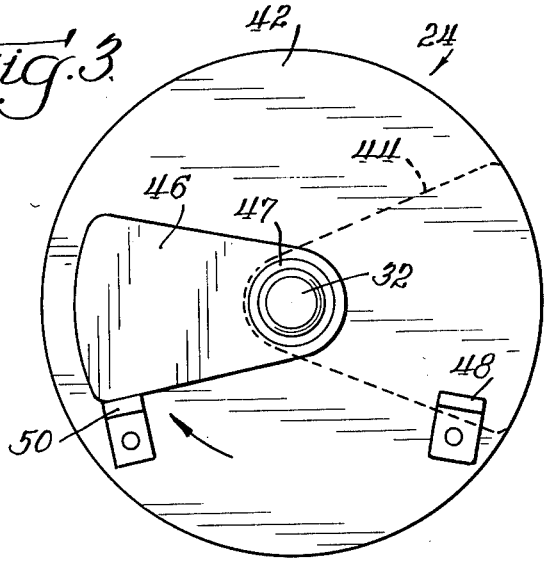
FIG. 3 is the same as FIG. 2, but with the upper minor eccentric weight out of coincidence with the upper major eccentric weight, as contrasted with FIG. 2 in which said weights are in coincidence.

The same elements for the upper portion 24 of the centrally-located vibrogyratory energizing unit are shown in FIG. 2, whereas no top plan view is given for the lower portion 26 of the vibrogyratory energizing unit 22. As shown in FIG. 2, minor and moveable eccentric weight 46 is in essential coincidence with fixed and major eccentric weight 44, said position of coincidence being defined by limit means in the form of drive lug 48 when the motor shaft is rotating in counterclockwise direction. As shown in FIG. 3, upon reversal of the motor, minor and moveable eccentric weight 46 is now in a position of non-coincidence with major and fixed weight 44, in fact approximately 180° opposed thereto, said position being defined by limit means in the form of stop lug 50 which becomes a driving lug when the shaft 32 is rotated in clockwise direction.

As shown in FIG. 1, weights 44 and 54 are usually approximately 90° out of phase with each other. According to the invention, such eccentric weights may and usually are between about 45° and 135° out of phase with each other, preferably about 90° out of phase with each other, and said FIG. 1 is to be considered as schematically showing said weights 44 and 54 approximately 90° out of phase with each other. Similarly, FIGS. 5 and 7.

Figure 4:
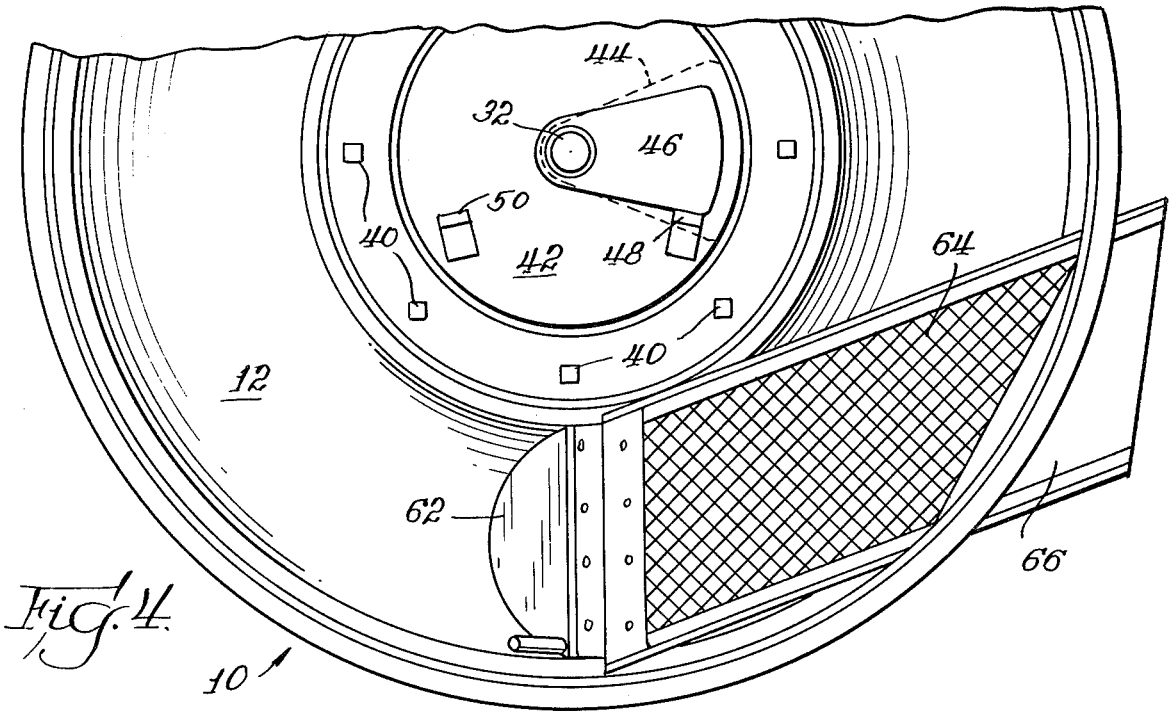
FIG. 4 is a partial top plan view of the machine of FIG. 1.

In FIG. 4 are shown the same elements as in FIGS. 2 and 3, except that sleeve bearing 47 is not identified therein, together with securing bolts 40, finishing chamber or tub 12, but also hinged unloading ramp 62, foraminous member in the form of screen or grate 64, and exit chute 66. Finishing chamber 12 in FIGS. 1–4 has an inclined bottom of approximately semicircular cross-section which terminates in a step at approximately the point at which the foraminous member 64 commences, so that the foraminous member is located just ahead of the step. The presence of flap or ramp 62 is accordingly optional, depending upon whether a single pass in the machine is sufficient to accomplish the desired degree of finishing or whether a plurality of passes is necessary or desirable, in which latter case the flap may be conveniently hinged for alternative location in the finishing chamber or out of it, depending upon whether a finishing cycle or a separation cycle is involved. Ramp 64 is not necessary if the foraminous member 64 commences at the step, but may be necessary if the foraminous member 64 is spaced some distance or height from the step, all as is well established in the art.

Figure 5:
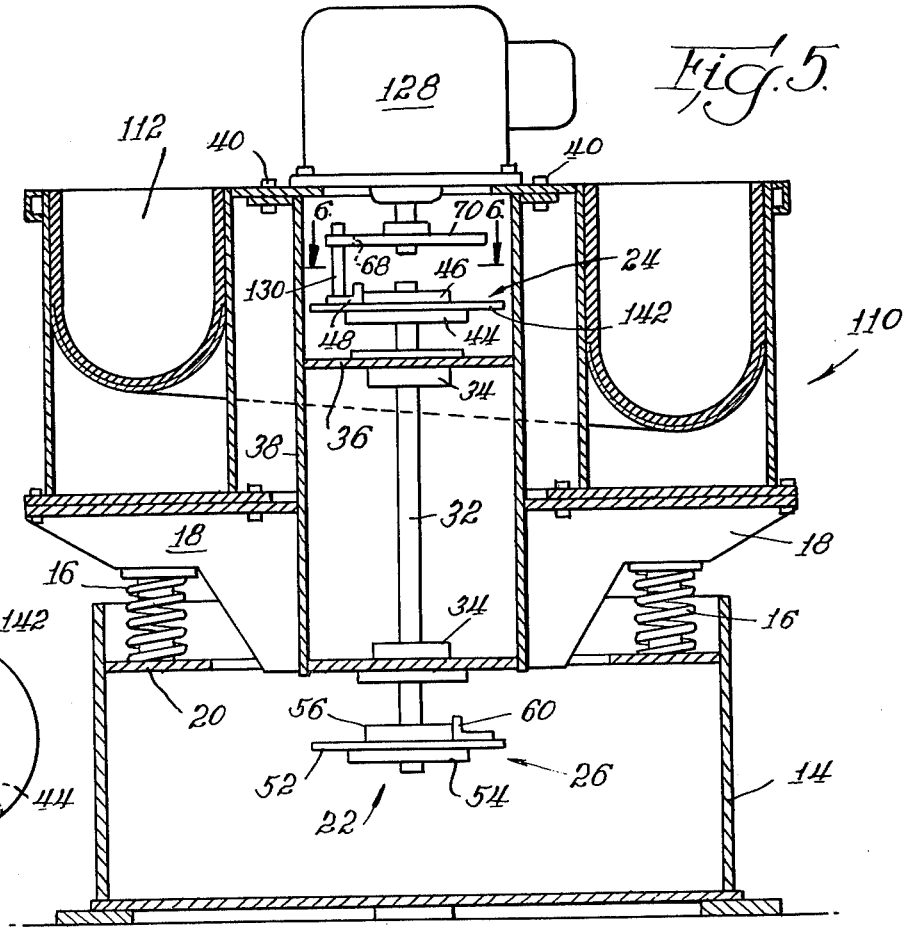
FIG. 5 is a vertical section view of another finishing machine according to the invention, embodying a vibrogyratory energizing unit according to the invention.
Figure 6:
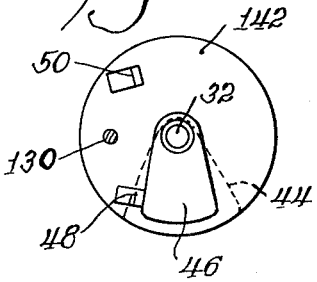
FIG. 6 is a top plan view of the upper portion of the vibrogyratory energizing unit taken along line 6—6 of FIG. 5 with the upper minor and major eccentric weights shown in coincidence.

FIG. 5 shows another embodiment of a finishing machine according to the invention, and embodying a centrally-located vibrogyratory package according to the invention, including pancake motor 128, the machine generally being shown at 110 and finishing chamber or tub at 112. Finishing chamber 112 in the embodiment of FIG. 5 has an inclined bottom terminating in a step, the bottom of the finishing chamber having an arcuate cross-section. Central shaft 32 is driven from pancake motor 128 by means of drive 70 having notch 68 and pin 130 into upper disc 142. Completing upper portion 24 of the centrally-located vibrogyratory energizing unit 22 along with disc 142 are minor free or moveable eccentric weight 46 and major and fixed eccentric weight 44, as well as drive lug 48, whereas bottom portion 26 of the unit 22 comprises lower disc 52, major and fixed weight 54, minor moveable weight 56, and stop lug 60. Stop lug 50 and drive lug 58 are not seen in the view of FIG. 5. FIG. 6 shows a top plan view along line 6—6 of FIG. 5, all of the foregoing enumerated elements being apparent and, in addition, stop lug 50 and pin 130.

Figure 7:
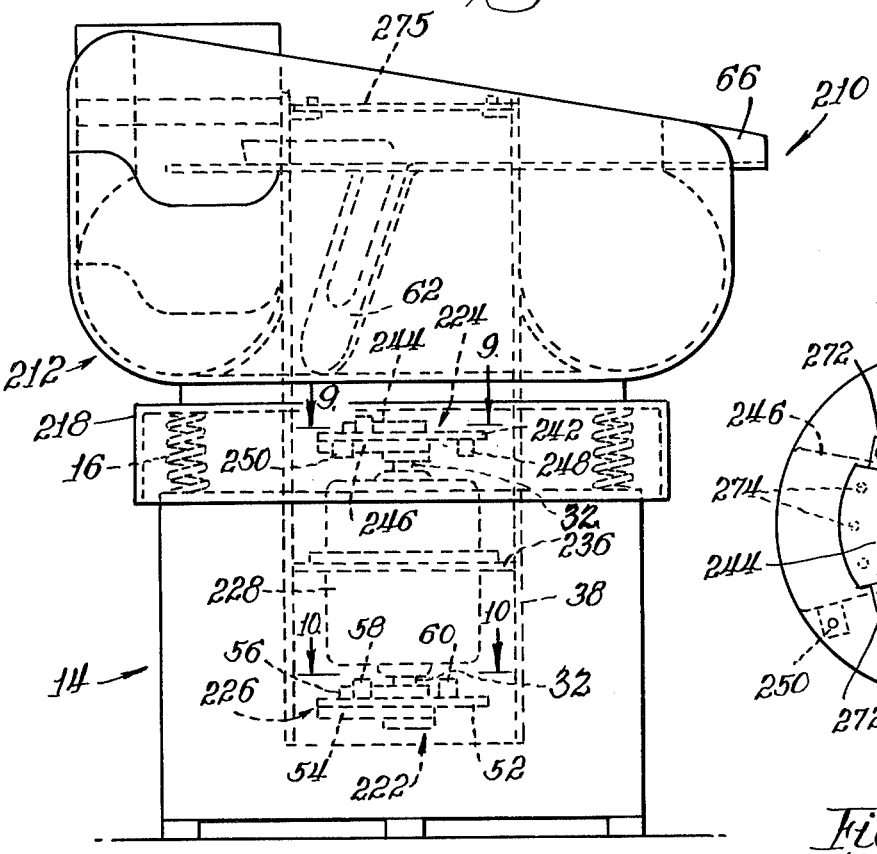
FIG. 7 is a side elevational view of a further vibratory finishing machine according to the invention with certain components, including the vibrogyratory energizing unit of the invention, illustrated in phantom lines.

In FIG. 7 is shown yet another embodiment of a finishing machine according to the invention embodying a vibrogyratory energizing unit according to the invention. The machine is generally shown at 210, finishing chamber or tub at 212, and the centrally-located vibrogyratory energizing unit at 222. Finishing chamber 212 in the embodiment of FIG. 7 has an essentially flat bottom which is arcuate in cross-section. In this embodiment, flap exit ramp 62 is hingedly secured to ride over the mass of finishing media and parts when they are traveling in counterclockwise direction, but adapted to receive the same for discharge when they are traveling in clockwise direction. The vibrogyratory energizing unit 222 comprises eccentric motor 228 having its central shaft 32 protruding at both ends, at which ends the four (4) eccentric weights are secured in the following manner.

The upper portion of the vibrogyratory energizing unit 222, as shown at 224, comprises upper disc 242 and fixed minor weight 244 secured in position by anchor lugs 272 bolted to disc 242. Major moveable weight 246 is shown on the bottom of disc 242 in a position of coincidence with upper fixed minor weight 244 and limited by drive lug 250 in clockwise direction and by drive lug 248 in counterclockwise direction, where it is approximately 180° out of coincidence with fixed minor weight 244. Also shown are multiple holes 274 for location of anchor lugs 272 for convenient changing of upper fixed minor weight 244 to a moveable weight and/or for changing major eccentric weight 246 from a fixed weight to a moveable weight, as desired.

At the bottom portion 226 of the energizing unit 222 is located disc 52, minor moveable weight 56, limit means in form of drive lug 58 in clockwise direction, and drive lug 60 in counterclockwise direction, with major weight 54 being fixed whereas minor weight 56 is moveable into and out of coincidence with major weight 54 to the extent defined by limit means 58 and 60.

In operation of any of the devices of FIGS. 1–6, the finishing material and parts to be finished are simply loaded into the finishing chamber 12, 112 and the centrally-located vibrogyratory energizing unit activated by activation of motor 28, 128, or 228. The mass of parts and workpieces moves in clockwise direction when shaft 32 moves in counterclockwise direction, at maximum intensity, since weights 46 and 44 and 56 and 54 are in essential coincidence for maximum intensity when shaft 32 moves in counterclockwise direction. Upon completion of the finishing cycle, either once around finishing chamber 12, 112 or after dropping hinged flap 62 (previously folded out of the way) for parts discharge, or after inserting an entire unit comprising exit flap 62, foraminous member 64, and exit chute 66 in the event the separation unit constitutes a separate insertable entity, the motor 28, 128, 228 is reversed (to clockwise) to throw the moveable weights 46 and 56 out of coincidence with fixed weights 44 and 54, preferably into a position approximately 180° opposed thereto. This results in a decrease in the intensity of the gyrovibrations during discharge of the finished parts from the machine and a substantial increase in the rate of feed of the mass as compared with a normal machine not employing the energizing device of the invention but operating at a reduced gyrovibrational intensity. In this stage, the finished parts and finishing media march up ramp 62 onto foraminous member 64 and out exit chute 66, while separated finished media falls through foraminous member 64 back into the finishing chamber 12, 112. In the event that, for any reason, it is desired to reverse the situation and employ a diminished intensity during a finishing operation and maximum intensity during parts discharge, it is a simple matter to carry out the process in reverse and simply rotate the motor in reverse (clockwise) during the finishing cycle and then reverse the motor (to counterclockwise) to give maximum intensity during the parts discharge and separation cycle, obviously with appropriate reversal of the position of the separation and parts discharge unit.

Alternative to the foregoing description of the structures of FIGS. 1–6 and the manner of operation thereof, the major weights at both ends of the shaft can be moveable and the minor weights can be fixed, in which case reversal of the drive means for the shaft has the same effect, namely, increase or decrease of intensity of vibrations and increased rate of feed at the lower intensities, the manner of operation being the same.

Figure 8:
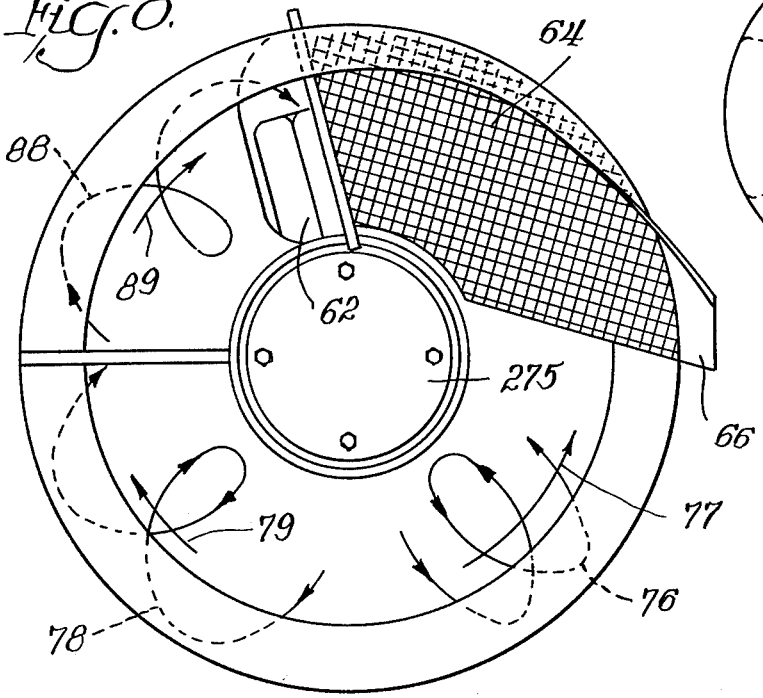
FIG. 8 is a top plan view of the machine shown in FIG. 7 illustrating the flow of materials therein.

In operation, the embodiment of FIGS. 7–10 is substantially the same. The finishing media and parts within finishing chamber 212 are subjected to vibrogyratory action by means of the vibrogyratory energizing unit 222 operating in clockwise direction with all weights at top 224 and bottom 226 of the unit 222 being in coincidence during the finishing stage to achieve both counterclockwise direction of movement of the mass within finishing chamber 212 and maximum intensity during the finishing operation. When the finishing cycle is complete, the motor 228 is reversed to counterclockwise, thereby moving moveable major weight 246 at the upper portion 224 of the unit 222 out of coincidence with fixed minor weight 244 concurrently with movement of minor moveable weight 56 out of coincidence with fixed major weight 54 at the lower portion 226 of the unit. This effectively reverses the force factor or component and reverses the flow of the mass of finishing media and parts within finishing chamber 212 to the clockwise direction, simultaneously reducing the intensity of the vibrogyrations but again increasing the rate of feed of the mass as compared with known machines operating at a reduced intensity of vibrations. The mass of finishing media and parts is thus forced up ramp 62 onto foraminous member 64 and out exit chute 66 for automatic separation of both finishing media and parts and then finished parts from finishing media, the separated finishing media dropping back through foraminous member 64 into finishing chamber 212 while finished parts march out exit chute 66. The arrows in FIG. 8 show the helical movement imparted to the mass of finishing media and parts within finishing chamber 212 along helical path 76 feeding in the direction of arrow 77 during the surface finishing operation. This is always opposite to the direction of rotation of the shaft 32 and generally also opposite to the direction of rotation of its drive means except when certain gearing is employed between the shaft and its drive means. During the finishing operation, ramp 62 may be folded above the mass or held in such position by any suitable means, not shown, or it may be allowed to ride atop the mass moving in counterclockwise direction. Rotation of the motor shaft and the upper and lower eccentric weights of the vibrogyratory energizing unit in counterclockwise direction will cause the mass of parts and finishing media within finishing chamber 212 to assume the opposite direction, that is, a clockwise direction, during a separation or discharge cycle, the motion of the mass during that cycle or phase being a helical motion as indicated by arrow 78 feeding in the direction of arrow 79 and continuing in helical path 88 and feeding in the direction of arrow 89 once the motor 228 and its shaft are reversed to counterclockwise direction for forcing the mass to move in clockwise direction, e.g., during the separation phase or cycle.

Figure 9:
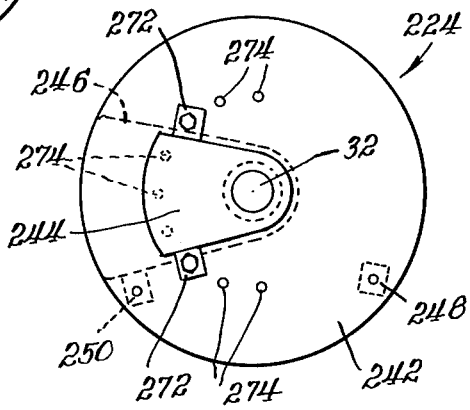
FIG. 9 is a top plan view of the upper portion of the vibrogyratory energizing unit taken along line 9—9 of FIG. 7 showing the upper minor and major eccentric weights in a position of coincidence.
Figure 10:
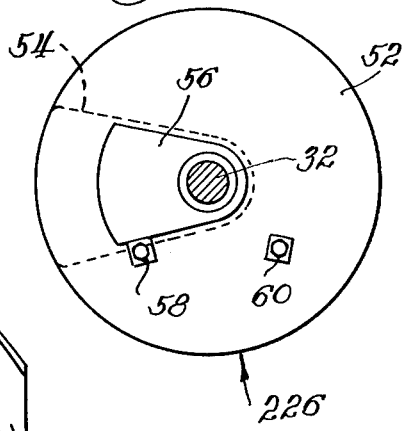
FIG. 10 is a top plan view of the bottom portion of the vibrogyratory energizing unit taken along line 10—10 of FIG. 7, showing lower minor and major eccentric weights in a position of coincidence.

As will be apparent from FIGS. 9 and 10, it is a simple matter by means of varying lugs and holes in plates 242 and 52 to change a weight from fixed to moveable and, although this variable securement is illustrated only with respect to upper portion 224 of the vibrogyratory energizing unit 222, where the variation between fixed and moveable is readily effected with respect to minor eccentric weight 244 and/or major eccentric weight 246, if desired, it will be apparent to one skilled in the art that the same variable securement means can readily be applied to the bottom portion 226 where one or more weights can be changed from fixed to moveable or vice versa, e.g., minor eccentric weight 56 and major eccentric weight 54 and that the possibility of such changes, when and if desired, is not necessarily restricted to the top portion 224 of the unit.

At any rate, when one of the minor weights and one of the major weights are out of coincidence with the other weights, especially 180° opposed thereto, as in the embodiment of FIGS. 7–10, not only will the direction of force factor or component and hence the direction of feed of the mass be reversed, but the vibrogyratory intensity will be at a minimum, as for a desired discharge and/or separation cycle, due to the fact that the major and minor weights will in such case be opposed to each other, thereby effectively reducing the mass and the vibrogyratory force provided by the unit, although the rate of feed is again increased as compared with known machines operating at a reduced intensity of vibrations.

Alternative to the foregoing description of the structure of FIGS. 7–10 and the manner of operation thereof, the situation can be reversed and the major and minor weights which are moveable can be moveable at a different end of the shaft, that is, instead of minor weights which are fixed with respect to the shaft at the top end of the shaft and moveable with respect to the shaft at the bottom end of the shaft, the minor weights can be fixed at the bottom and moveable at the top. Conversely, instead of a major weight moveable with respect to the shaft at the top end of the shaft and fixed with respect to the shaft at the bottom end of the shaft, the major weight can be fixed at the top end of the shaft and moveable at the bottom end of the shaft, to accomplish the same result, namely, alteration of the intensity of vibrations upwardly or downwardly and for reversal of the force factor and the direction of flow of a mass of media and parts within a finishing chamber, albeit with relatively or comparatively increased rate of feed, the manner of operation being the same, all as will be readily apparent to one skilled in the art.

The method of the invention is a method according to which a certain level of vibrogyratory intensity produces a certain rate of feed of the mass of parts or workpieces and media within a finishing chamber but, according to the invention, a reduction in the vibrogyratory intensity does not correspondingly diminish the rate of feed. By "rate of feed" is meant the rate of linear procession or precession along the finishing chamber as opposed to the orbital motion imparted to the mass within the finishing chamber under ordinary finishing conditions due to the vibrogyratory motion imparted to the mass. In other words, by the employment of a finishing machine and vibrogyratory energy package according to the invention, it is possible to effect an increased rate of feed at a particular vibrogyratory intensity as contrasted to the rate of feed normally effected at the same vibrogyratory intensity in a standard finishing machine having a usual vibrogyratory energy package. Alternatively, the same rate of feed may be effected using less vibrational intensity than in such a standard finishing machine. In addition, of course, when the force factor is reversed, concurrently with reduction or increase of vibrogyratory intensity, the direction of feed of the mass of parts or workpieces and media within the finishing chamber of a finishing machine will also be correspondingly reversed.

COMPARATIVE EXAMPLE 1

In an ST4, four cubic foot capacity Spiratron (Trademark of Roto-Finish Company, Inc.) finishing machine having a vibrogyratory means within a central column of the type shown in FIG. 1, but using two standard weights at the top and bottom of the vertical shaft, the said standard weights each having a force of top 1030 pounds; bottom 2000 pounds, and each being approximately 90° out of phase with the other, various test parts of metal are finished with ceramic-bonded abrasive media. The test parts are steel washers, the weight of the metal is 30 pounds, and the amount of the finishing media is 300 pounds. The size of the finishing media is $\frac{1}{2}'' \times \frac{1}{2}'' \times \frac{1}{2}''$ and it is in the form of triangles. The vibrogyratory energy package is activated and the vibrogyratory intensity is found to be 2 mm. At this vibrogyratory intensity, the rate of feed of the mass of parts and finishing media around the finishing chamber of the finishing machine is 1 foot per minute.

COMPARATIVE EXAMPLE 2

An ST4 MOD I is employed instead of the ST4. This modification of the ST4 Spiratron (Trademark of Roto-Finish Company, Inc.) is exactly the same except for the energy package thereof, which is in all respects the same as shown in FIGS. 1–3 of the drawings The standard metal test parts and finishing media and all other conditions and characteristics of the test and all of the items present in the finishing chamber are identical with those employed in Comparative Example 1.

The vibrogyratory energy package of the ST4 MOD I is activated and the vibrogyratory intensity at the maximum is found to be 5 mm. The rate of feed of the mass of parts and finishing media within the finishing chamber is found to be 4 feet per minute.

The direction of rotation of the energy package is reversed for reduction of the vibrogyratory intensity which, upon reversal, is found to be 2 mm. At this vibrogyratory intensity, the rate of feed of the mass of parts and finishing media around the finishing chamber is found to be 2 feet per minute.

In this embodiment of the ST4 MOD I, the force of each of the two major weights at the top and bottom of the essentially vertical shaft is top 1543 pounds; bottom 1576 pounds, and the force of each of the minor eccentric weights at the top and bottom of the shaft is, at high intensity, top 611 pounds; bottom 544 pounds. The sum of forces at the top is 2154 pounds. The sum of forces at the bottom is 3120 pounds.

It is obvious from the foregoing that, in Comparative Example 2, the rate of feed of the mass is greater than in Comparative Example 1, although operating at the same intensity.

COMPARATIVE EXAMPLE 3

The Comparative Example 2 is repeated, but employs an ST4 MOD II, which is identical to the ST4 except that it has no stepped bottom and that the energy package employed is identical with that in FIGS. 7–10 of the drawings herein. The test is in all other respects identical to Comparative Example 2 and Comparative Example 1.

The force of the major weights at the top and bottom of the vertical shaft in this embodiment of the ST4 MOD II is top 1543 pounds; bottom 1576 pounds, whereas the force of each of the minor eccentric weights at the top and bottom of the shaft is top 611 pounds; bottom 544 pounds.

The vibrogyratory energy package is activated and the finishing machine is operated at a vibrogyratory intensity of 5 mm. At this vibrogyratory intensity, the rate of feed of the mass of parts and finishing media within the finishing chamber is 4 feet per minute.

The direction of rotation of the shaft is reversed, whereupon the force factor is reversed and the direction of feed of the mass is also reversed. Reversal of the direction of rotation of the shaft also reduces the vibrogyratory intensity to 2 mm, at which level the rate of feed of the mass within the finishing chamber is 2 feet per minute.

Here again, Comparative Example 3 produces a rate of feed which is greater than the rate of feed of the mass in Comparative Example 1, at the same vibrogyratory intensity, but the direction of feed has been reversed.

As already stated, the increased rate of feed at the same or lower vibrogyratory intensities is a valuable characteristic of the energy package of the present invention and finishing machines comprising the same, inasmuch as it permits employment of lower vibrogyratory intensities to obtain equal or higher rates of feed than previously attainable so that the separating device is not flooded with finished parts during a separation cycle because of unnecessarily and undesirably high vibrogyratory intensities.

COMPARATIVE EXAMPLE 4

In each of Comparative Examples 1–3, the ST4 Spiratron (Trademark of Roto-Finish Company, Inc.) is subjected not only to a finishing cycle but also to a separation cycle. When operating at the same vibrogyratory intensity as the ST4 in Comparative Example 1 the ST4 MOD I and the ST4 MOD II have a higher rate of feed of the mass, thereby bringing finished parts to the separating zone involving a foraminous member as shown in FIGS. 4 and 8 at acceptable intervals. However, when the vibrogyratory intensity of the ST4 in Comparative Example 1 is increased, the resulting increased rate of feed of the mass floods the foraminous member with finished parts and an excessive amount of finishing material which can not be handled by the foraminous member due to the added vibrogyratory intensity whereas, at the lower intensities, the rate of feed of the ST4 is less than desired for rapid and efficient separation (as further shown in Comparative Example 5).

COMPARATIVE EXAMPLE 5

The ST4 machine of Comparative Example 1 is operated under conditions identical to those in each of the foregoing Comparative Examples. The ST4 is first operated at a vibrogyrational intensity of 5 mm, giving rise to a rate of feed of the mass around the finishing chamber of 4 feet per minute. The vibrogyrational intensity is then reduced to 2 mm, at which point the rate of feed of the mass around the finishing chamber drops to 1 foot per minute.

Thus, considering the results set forth in Comparative Examples 2 and 3 with the results of Comparative Examples 1 and 5, when one vibrogyratory intensity is employed in the ST4 MOD I or ST4 MOD II as in Comparative Examples 2 or 3 and then the vibrogyratory intensity is reduced, the rate of feed of parts and media is not correspondingly reduced (i.e., reduced to the same extent) as compared with the standard ST4 finishing machine having a usual vibrogyratory energizing unit.

Alternative to reversal of the direction of rotation of the shaft having the variable eccentric weights at both ends thereof, as fully set forth in the foregoing disclosure, drawings, and specific description of the invention, other means for varying the position of the moveable weights at both ends of the substantially vertical shaft may be employed. Shaft reversal is only one mechanical way of effecting movement of the moveable eccentric weights from one position to another at the ends of the shaft, that is, into substantial coincidence with a fixed eccentric weight at the same end of the shaft and out of coincidence with the fixed eccentric weight at the same end of the shaft, all as set forth in the foregoing. Said alternative means for effecting movement of the moveable weights at either or both ends of the shaft are available and will be readily apparent to one skilled in the art. Such means may be mechanical, pneumatic, hydraulic, or electric, and representative means are apparent from U.S. Pat. Nos. 3,435,564, 3,466,815, and 3,606,702 by way of illustration only and not by way of limitation. For example, the actuator for effecting movement of a moveable eccentric weight between two positions at either or both ends of the essentially vertical shaft may be fluid operable and with a rotary coupling with a portion thereof fixed in relation to the finishing machine and another portion thereof fixed in relation to the shaft and adapted to transfer fluid from said fixed portion to said rotary portion, with means provided for conducting the fluid from the rotary coupling means to the actuator means, as disclosed in U.S. Pat. No. 3,606,702, and the fluid involved may be compressed air or hydraulic fluid. Alternatively, the actuator means can be electrically operable and the rotary coupling means may be adapted to transfer electricity from a stationary supply source to the actuator means, also as disclosed in U.S. Pat. No. 3,606,702, the actuator means disclosed in the said patent being particularly well adapted for effecting movement of moveable eccentric weight or weights according to the present invention from one position to another at either or both ends of the essentially vertical shaft, all as will be readily apparent to one skilled in the art.

Reference has been made herein to the fact that the normal displacement of eccentric weights at opposite ends of the shaft is generally between about 45° and 135° out of phase with each other, and preferably about 90° out of phase with each other. These eccentric weights are out of phase for purposes of providing vibrogyrations as opposed to vibrations, and generally the two eccentric weights which are out of phase with each other at opposite ends of the shaft are fixed weights. They are also generally major eccentric weights although, when a lesser degree of intensity of vibrogyrations is desired, the two eccentric weights which are out of phase with each other may be one major and one minor eccentric weight at opposite ends of the shaft. It is moreover not essential that the out-of-phase eccentric weights be fixed so long as, in their normal positions at opposite ends of the shaft, during counterclockwise and clockwise rotation thereof, they are displaced with respect to each other, that is, normally between about 45° and 135° out of phase with each other, and preferably about 90° out of phase with each other. As already stated, the out-of-phase weights are generally but not necessarily fixed and are also usually but not necessarily two major eccentric weights.

When two weights having approximately the same mass at opposite ends of the shaft are referred to herein, they are sometimes referred to as "similar" weights whereas, when two weights having different masses at opposite ends of the shaft are referred to herein, they are sometimes referred to as "dissimilar" weights. Thus, two major or two minor weights at opposite ends of the shaft may be referred to as "similar" weights, whereas a major and a minor weight at opposite ends of the shaft may be referred to as "dissimilar" weights.

Although the finishing chamber of the machine of the present invention and the upstanding walls thereof may always be characterized as generally "annular", it is not essential that such wall or chamber or part thereof be annular in any precise circular sense of the term. It is only necessary that the finishing chamber and any such part thereof or any such defining or surrounding wall thereof be generally annular, that is, insufficiently cornered so as to prevent the free flow of finishing media and parts to be finished therein in and around the interior of the finishing chamber. For example, the finishing chamber and any surrounding or outer or defining wall thereof may have a decagonal, octagonal, hexagonal, or pentagonal cross-section, or any other somewhat cornered cross-section which does not detract from its generally-annular nature or interfere with the flow of parts and media about the interior of the finishing chamber. Although for purposes of ultimate convenience and operating efficiency, a circular annular finishing chamber is preferred, other generally-annular finishing chambers may be employed with equal or only somewhat reduced efficiency, as will be apparent to one skilled in the art.

The bottom of the finishing chamber is preferably arcuate, especially semicircular, in nature, as shown in the drawings and as already well-established in the art.

It is to be understood that the term "finishing media" is used generally herein to designate materials used to impart all types of finishes, including those finishes acquired with abrading material as well as with polishing material, and that polishing, abrading, deburring, edgebreaking, buffing, burnishing, and the like, are as usual only species of finishing. The term "finishing media", as used herein, is also intended to include all such materials which serve as loose, particulate, and solid finishing materials of the type presently employed in the trade and others of a similar nature whether natural or synthetic, including stone, porcelain, abrasive-filled clays, plastics, ceramics, wood, leather, or the like, and in any suitable shape or form as may be employed for the surface finishing, refinement, and/or deburring of parts or workpieces, which are usually of metal or plastic.

From the foregoing, it will be seen that novel finishing machines and vibrogyratory energizing units, having all of the desirable characteristics set forth in the foregoing and having none of the shortcomings or disadvantages of such prior art apparatus, and whereby all of the objects of the invention may be accomplished, have been provided by the present invention.

It is to be understood that the invention is not to be limited to the exact details of construction, operation, or exact materials or embodiments shown and described, as obvious modifications and equivalents will be apparent to one skilled in the art, and the invention is therefore to be limited only by the full scope of the appended claims.

I claim:

1. In a finishing machine for finishing the surface of unfinished parts with finishing media, comprising a generally annular finishing chamber for receiving unfinished parts and finishing media and for finishing parts therein, said finishing chamber comprising a bottom and upstanding side walls, vibratory means for vibration of said finishing chamber centrally located with respect to said finishing chamber, said vibratory means comprising a substantially vertical shaft having top and bottom eccentric weights, one or more of which eccentric weights being free for movement with respect to said shaft, means operatively associated with any said movable weight for effecting movement of any said movable weight within limits, and limit means limiting the extent of movement of any said moveable eccentric weight, the improvement characterized in that said vibratory means comprises dissimilar, i.e., major and minor, eccentric weights at each end of said shaft, one of said eccentric weights at each end of said shaft being fixed with respect to said shaft, the other of said eccentric weights at each end of said shaft being freely moveable with respect to said shaft and freely moveable into substantial coincidence with said fixed eccentric weight at the same end of said shaft and out of coincidence with said fixed eccentric weight at the same end of said shaft, and said limit means defining the degree of permissible movement of said freely moveable eccentric weight at each end of said shaft with respect to said shaft and with respect to said fixed eccentric weight at the same end of said shaft, for respectively (a) varying the intensity of vibrations imparted by said vibratory means, or (b) reversing the direction of the force factor imparted by said vibratory means and hence the direction of flow of mass within said finishing chamber concurrently with a variation in the intensity of vibrations imparted by said vibratory means, wherein said two of said fixed eccentric weights at opposite ends of said shaft are between about 45 and 135 degrees out of phase with each other and wherein said limit means comprises limit means defining a position wherein said moveable weights are up to approximately 180 degrees opposed to said fixed weights.

2. A finishing machine of claim 1, wherein two similar weights at opposite ends of said shaft are freely moveable with respect to said shaft for varying the intensity of vibrations.

3. A finishing machine of claim 2, wherein the other two weights are similar weights and are fixed weights.

4. A finishing machine of claim 2, wherein the two similar moveable weights are minor weights.

5. A finishing machine of claim 1, wherein two dissimilar weights at opposite ends of said shaft are freely moveable with respect to said shaft for altering the intensity of vibrations and for reversing the force factor and direction of flow of the mass of media and parts within the finishing chamber.

6. A finishing machine of claim 5, wherein the other two weights are dissimilar weights and are fixed weights.

7. A finishing machine of claim 6, wherein the dissimilar weights comprise one major weight and one minor weight.

8. A finishing machine of claim 1, wherein said out of phase weights are major weights.

9. A finishing machine of claim 1, wherein said out of phase weights are one major and one minor weight.

10. A finishing machine of claim 1, wherein said fixed weights and freely moveable weights at each end of said shaft are in essential coincidence at one position defined by said limit means for imparting maximum intensity of vibrogyrations to said finishing chamber.

11. A finishing machine of claim 1, wherein said fixed eccentric weights are approximately 90° out of phase with each other.

12. A finishing machine of claim 1, wherein said annular finishing chamber has an exit opening for exit of finished parts therefrom.

13. A finishing machine of claim 1, wherein said annular finishing chamber has a substantially flat bottom.

14. A finishing machine of claim 1, wherein said annular finishing chamber has an inclined bottom.

15. A finishing machine of claim 14, wherein said inclined bottom comprises a step.

16. A finishing machine of claim 14, wherein said inclined bottom comprises a step and wherein a foraminous member is provided at a level elevated with respect to said bottom of said finishing chamber at or near said step for separation of finished parts from finishing media.

17. A finishing machine of claim 16, wherein said foraminous member is associated with a parts exit.

18. A finishing machine of claim 13, wherein a foraminous member is mounted at an elevated position with respect to the bottom of said finishing chamber for separation of finished parts from finishing media.

19. A finishing machine of claim 18, wherein said foraminous member is associated with a parts exit and a ramp for elevation of parts and finishing media to said foraminous member.

20. A finishing machine of claim 1, wherein any moveable weight is adapted to move upon impact, and including reversible drive means for said shaft operatively associated with said shaft and thereby with said weight for providing impact to any said moveable weight by reversal of said drive means.

21. A finishing machine of claim 20, wherein said drive means for said shaft comprises a motor with associated pulley and belt means which is mounted on said finishing chamber or on a support therefor.

22. A finishing machine of claim 20, wherein said drive means for said shaft comprises a motor and said shaft is the shaft of said motor.

23. A vibrogyratory energizing unit, especially suitable for use in a finishing machine for finishing the surface of unfinished parts with finishing media, comprising a generally annular finishing chamber for receiving unfinished parts and finishing media and for finishing parts therein, said finishing chamber comprising a bottom and upstanding side walls and vibrogyratory means for vibration of said finishing chamber centrally located with respect to said finishing chamber, said vibrogyratory unit comprising a substantially vertical shaft having dissimilar, i.e., major and minor, eccentric weights at each end of said shaft, one of said eccentric weights at each end of said shaft being fixed with respect to said shaft, the other of said eccentric weights at each end of said shaft being freely moveable with respect to said shaft and freely moveable into substantial coincidence with said fixed eccentric weight at the same end of said shaft and out of coincidence with said fixed eccentric weight at the same end of said shaft, limit means defining the degree of permissible movement of said freely moveable eccentric weight at each end of said shaft with respect to said shaft and with respect to said fixed eccentric weight at the same end of said shaft, for respectively (a) varying the intensity of vibrations imparted by said vibrogyratory means, or (b) reversing the direction of the force factor imparted by said vibrogyratory means and hence the direction of flow of mass within said finishing chamber concurrently with a variation in the intensity of vibrations imparted by said vibrogyratory means, wherein said two of said fixed eccentric weights at opposite ends of said shaft are between about 45 and 135 degrees out of phase with each other and wherein said limit means comprises limit means defining a position wherein said moveable weights are up to approximately 180 degrees opposed to said fixed weights.

24. An energizing unit of claim 23, having means associated with any said freely moveable weight for effecting movement of any said moveable weight within limits.

25. An energizing unit of claim 24, wherein two similar weights at opposite ends of said shaft are moveable with respect to said shaft for varying the intensity of vibrations.

26. An energizing unit of claim 25, wherein the other two weights are similar weights and are fixed weights.

27. An energizing unit of claim 25, wherein the two similar moveable weights are minor weights.

28. An energizing unit of claim 24, wherein two dissimilar weights at opposite ends of said shaft are freely moveable with respect to said shaft for altering the intensity of vibrations and for reversing the force factor and direction of flow of a mass of media and parts within a finishing chamber.

29. An energizing unit of claim 28, wherein the other two weights are dissimilar weights and are fixed weights.

30. An energizing unit of claim 29, wherein the dissimilar weights comprise one major weight and one minor weight.

31. An energizing unit of claim 23, wherein said out of phase weights are major weights.

32. An energizing unit of claim 23, wherein said out of phase weights are one major and one minor weight.

33. An energizing unit of claim 24, wherein said fixed weights and freely moveable weights at each end of said shaft are in essential coincidence at one position defined by said limit means for imparting maximum intensity of vibrogyrations to said finishing chamber.

34. An energizing unit of claim 23, wherein said fixed eccentric weights are approximately 90° out of phase with each other.

35. An energizing unit of claim 24, wherein any moveable weight is adapted to move upon impact, and including reversible drive means for said shaft operative associated with said shaft and thereby with said weight for providing impact to any said moveable weight by reversal of said drive means.

36. An energizing unit of claim 35, including drive means for said shaft comprising a motor.

37. An energizing unit of claim 36, wherein said shaft is the shaft of said motor.

38. An energizing unit of claim 35, including drive means for said shaft comprising a motor with associated pulley and belt means adapted to be mounted on a finishing chamber or on a support therefor.

* * * * *